United States Patent [19]

Walter

[11] Patent Number: 5,042,800

[45] Date of Patent: Aug. 27, 1991

[54] SPINE TENSIONING BODY SUPPORT

[76] Inventor: Brian A. Walter, 1112 Kinau St., #1110, Honolulu, Hi. 96814

[21] Appl. No.: 486,080

[22] Filed: Feb. 28, 1990

[51] Int. Cl.[5] ..... A63B 21/00

[52] U.S. Cl. ..... 272/144; 272/63; 272/145; 272/DIG. 4; 297/423; 128/75

[58] Field of Search ..... 272/63, 93, 123, 134, 272/144, 145, DIG. 4; 128/25 R, 71-75; 269/322-328; 297/423

[56] References Cited

U.S. PATENT DOCUMENTS

| | | | |
|---|---|---|---|
| 1,804,441 | 5/1931 | Silva . | |
| 2,112,678 | 3/1938 | Rausch . | |
| 2,248,369 | 7/1941 | Ludersen . | |
| 3,766,912 | 10/1979 | Daniels . | |
| 3,948,513 | 4/1976 | Pfotenhauer | 272/144 |
| 4,144,880 | 3/1979 | Daniels . | |
| 4,332,381 | 6/1982 | Lyons . | |
| 4,432,108 | 2/1984 | Chapman . | |
| 4,602,619 | 7/1986 | Wolf et al. | 128/75 |
| 4,621,809 | 11/1986 | Pearl | 272/123 |
| 4,629,180 | 12/1986 | Kata | 272/144 X |
| 4,669,724 | 6/1987 | Matheisen | 128/75 X |
| 4,678,187 | 7/1987 | Prsala . | |
| 4,793,655 | 12/1988 | Kvalheim . | |
| 4,884,804 | 12/1989 | Fenwick | 272/144 X |

*Primary Examiner*—Robert Bahr

*Attorney, Agent, or Firm*—Martin E. Hsia

[57] ABSTRACT

A spine tensioning apparatus comprising a back support that supports only the back, but not the posterior, and a leg support having an inverted V cross section spaced apart from and aligned with the back support. Preferably the back support and the leg support are mounted on vertical risers attached to a horizontal base. The vertical risers can be posiitoned so that when a user reclines in the apparatus, the user's back and legs, but not the posterior, are supported, thereby creating tension along the spine.

21 Claims, 6 Drawing Sheets

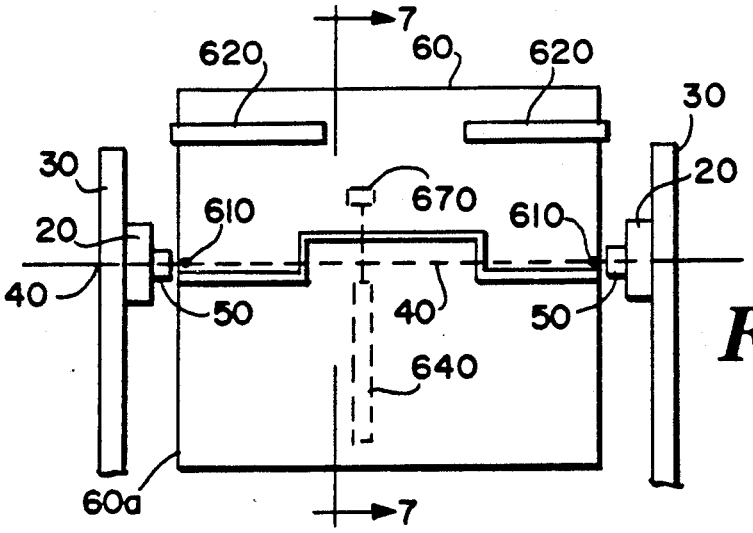
Fig. 6
Fig. 10
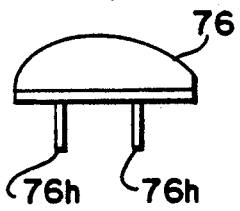
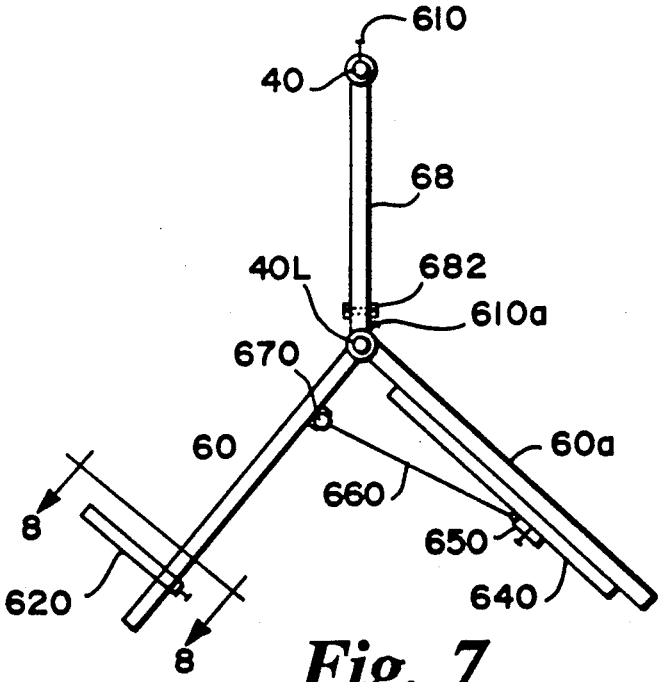
Fig. 7
Fig. 8
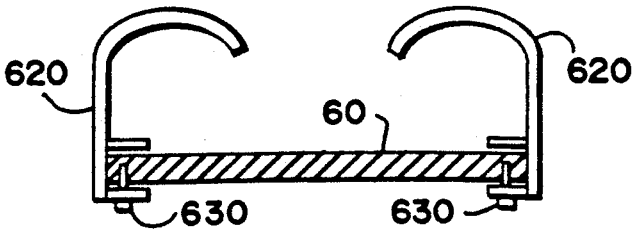

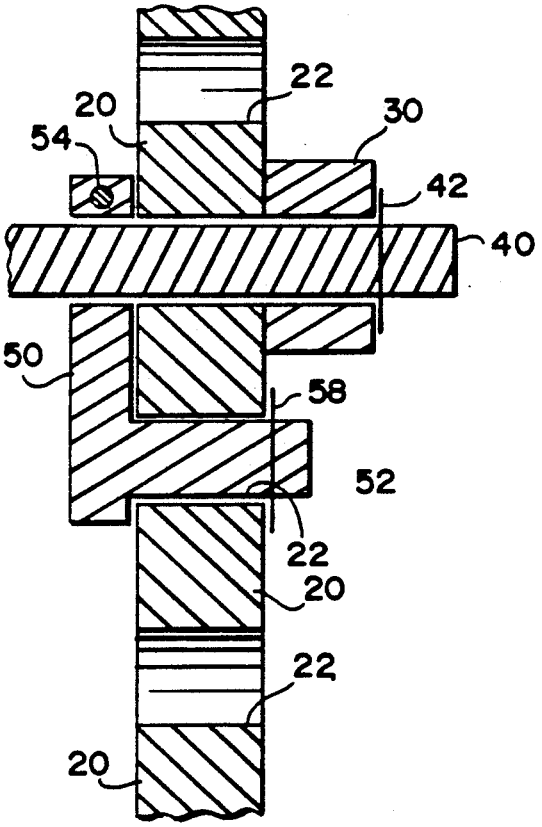
Fig. 12
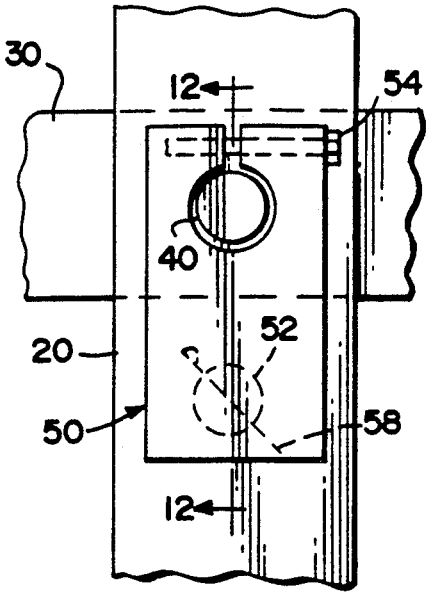
Fig. 11
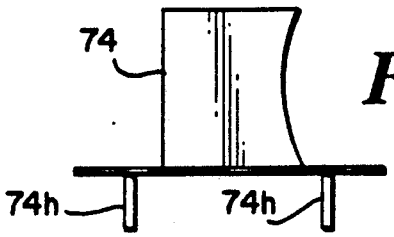
Fig. 9
Fig. 13
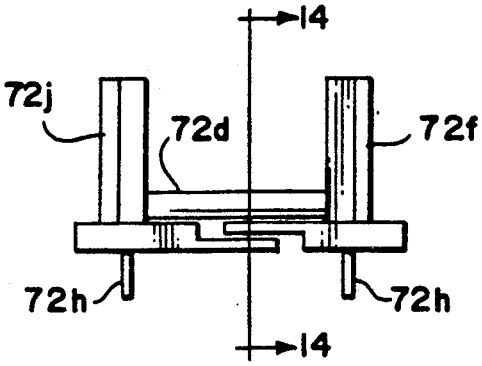
Fig. 14
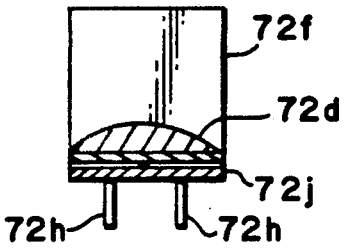

*Fig. 16*
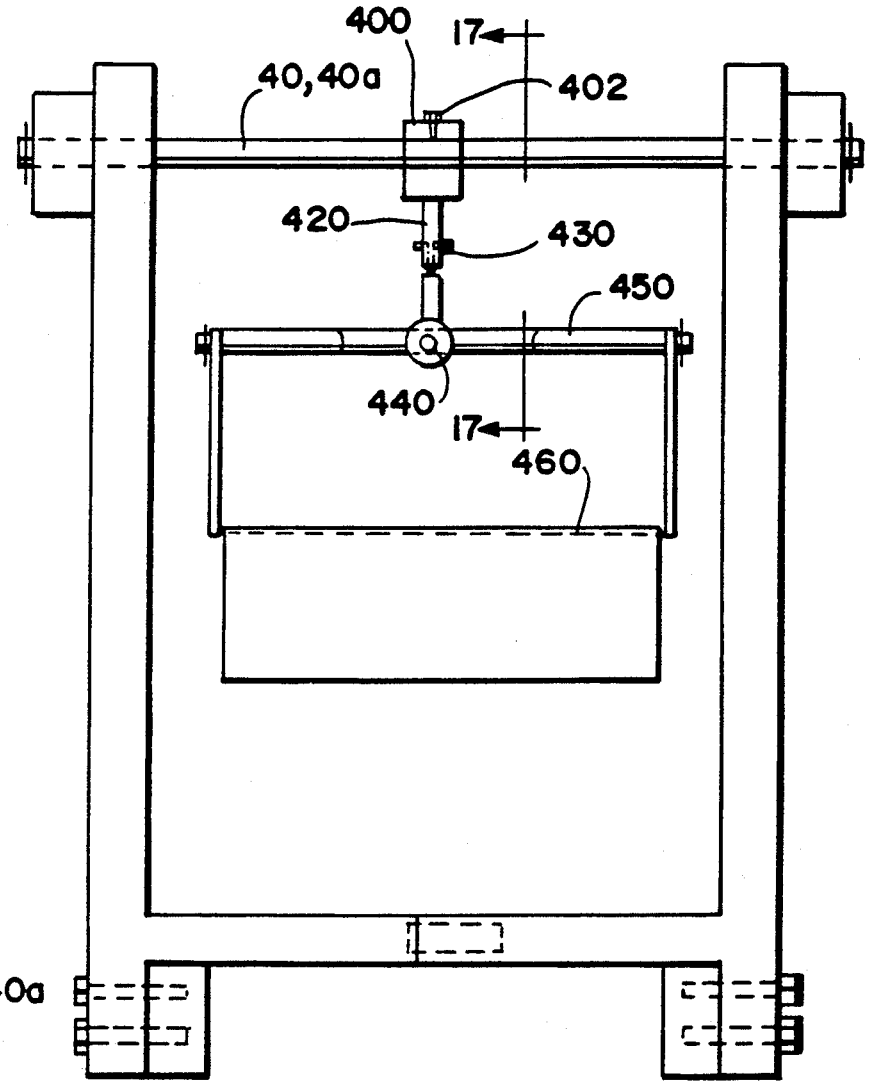
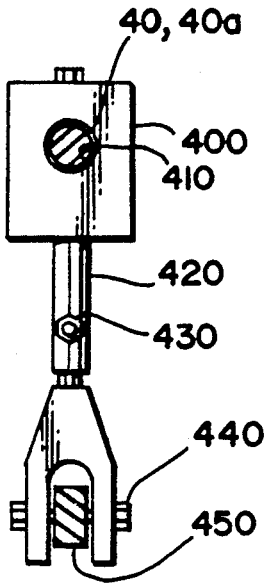
*Fig. 17*

SPINE TENSIONING BODY SUPPORT

BACKGROUND OF THE INVENTION

This invention relates to an apparatus for supporting a human body at rest so that the spine is subjected to limited tension and also, if so desired, the user can exercise spine related muscles.

Back pain can be considered a national health problem, estimated to affect 70–80% of Americans at some time in their adult life.

Physical therapists generally rely on four methods to treat common back pain: heat, ice, exercise and traction. Some feel that continued muscle contraction can cause muscles to ache, and that this could be a major cause of common back pain. They also feel that traction may relieve muscle tension, thus reducing back pain. In addition, they also feel exercise can strengthen back-related muscles, which may inhibit the reoccurrence of back pain.

The problems most people face in dealing with back pain are that: (1) in some cases, it is costly to retain the professional services of a therapist, chiropractor or physician; (2) it takes time to be treated or to exercise or stretch; and (3) effort must be spent to stretch or exercise sufficiently in order to obtain relief.

In summary, present means for treating back pain may require some combination of the following: money, time and effort.

There are many patents that relate to apparatus for treating back pain, including the following:

U.S. Pat. No. 4,793,655 to Kvalheim discloses a chair with a seat rest and separate back rest. However, it cannot provide for spine tensioning because it supports the user's posterior.

U S. Pat. Nos. 4,144,880 and 3,766,912 to Daniels teach an orthopedic table having two tiltable portions whereby tension of the spine is achieved by chains, straps or the like attached to the user's head and feet and tilting the portions of the table towards each other. This table probably requires the attendance of a professional physician or operator, with the associated expense.

U.S. Pat. No. 4,678,187 to Prsala discloses a body support device whereby a user's body is supported at the arms and feet. The device may require its user to be physically fit in order to endure the forces on the body from support limited to the arms and feet.

U.S. Pat. No. 4,432,108 to Chapman, U.S. Pat. No. 2,248,369 to Ludersen and U.S. Pat. No. 2,112,678 to Rausch all teach leg supports, but do not teach spine tensioning.

U.S. Pat. No. 4,332,381 to Lyons discloses an exercising device having a high platform and spaced low platforms supported on an H shaped frame adapted to have a user rest his feet on the high platform and support his hands on the low platform and do push-ups.

U.S. Pat. No. 1,804,441 to Silva discloses a vertabrae stretcher in which the user may pivot his or her horizontal position to hang upside down, suspended from the knees. This type of upside down body positioning may be unfavorable to the user's circulatory system.

It is thus an object of this invention to provide a simple apparatus to support a human body at rest so that the spine is subjected to a tension that is limited in amount for safety and convenience.

It is a further object of this invention to enable a user, while subjecting his or her spine to a limited tension, to perform tasks similar to those afforded to one sitting in a chair, i.e. able to read, drink, talk, relax, watch television, etc.

It is also an object of this invention to provide an economical means of subjecting one's spine to a limited tension (to alleviate back pain).

Another object of this invention is to provide an apparatus that can be used at home or on any flat surface, whenever desired.

Another object of this invention is to provide a body support device in which the user may, while subjecting his or her spine to a limited tension, perform various exercises that may strengthen muscles to reduce the probability of reoccurrence of back pain.

Another object of this invention is to provide a body support device that can be easily converted to function as any one of a chair, a horizontal resting plane, a spine tensioner, a muscle exerciser, or combinations thereof.

A further object of this invention is to provide a body support device which may be shipped and store in a flat condition and be readily erected into condition for use.

A further object of this invention is to provide a body support device in which the amount of limited tension on the spine can be adjusted from no tension to maximum limited tension.

Still another object of this invention is to provide a body support for spine tensioning which allows the back and leg supports to rotate freely, simulating the movements afforded one in a rocking chair.

BRIEF SUMMARY OF THE INVENTION

These and other objects are accomplished by a spine tensioning apparatus that includes a back support with a substantially planar surface that supports only the user's back (and does not support the posterior) and a leg support having an inverted V cross section spaced apart from and aligned with the back support, with positioning means for positioning the back support and the leg support in aligned, spaced apart relationship. Preferably the back support and the leg support are maintained in position by being mounted on a horizontal base having vertical risers which are attached to the back and leg supports The vertical risers allow the two basic elements (the back support and the leg support) to assume varying positions in relation to each other, both vertically and horizontally. The varying positions attainable with the two basic elements enables the support device to provide support as a chair and as a horizontal surface. Spine tensioning is attained when these two basic elements are arranged such that there is no posterior support. It is the absence of this posterior support that causes the spine to be subjected to a limited tension.

The inverted V shaped leg supports allow tension to be provided without requiring any additional means to retain the user's legs in place because the user's legs are simply hooked over the inverted V, with the user's knees at the apex. By contrast, the patents to Daniels require chains or other devices to retain the user's legs in place.

BRIEF DESCRIPTION OF THE DRAWINGS

FIG. 6 is a top plan view of the leg support of FIG. 1 with shin cups added;

FIG. 7 is a side elevational view of the leg support of FIG. 6 with alternate support shown;

FIG. 8 is a section taken along the line 8—8 in FIG. 7;

FIG. 9 is a side view of the armpit piece 74 shown in FIG. 1;

FIG. 10 is a side view of the lumbar support piece 72 shown in FIG. 1;

FIG. 11 is a side view of a typical rod tensioner 50 shown in FIGS. 1 and 2;

FIG. 12 is a section taken along the line 12—12 in FIG. 11;

FIG. 13 is a front view of the neck support piece 72 shown in FIG. 1;

FIG. 14 is a view taken along the line 14—14 in FIG. 13;

FIG. 16 is a front view of an alternate leg or back support allowing vertical rotational movement with resistance and horizontal rotation with resistance;

FIG. 17 is a section taken along line 17—17 in FIG. 16;

DESCRIPTION OF THE PREFERRED EMBODIMENT

Figure 1:
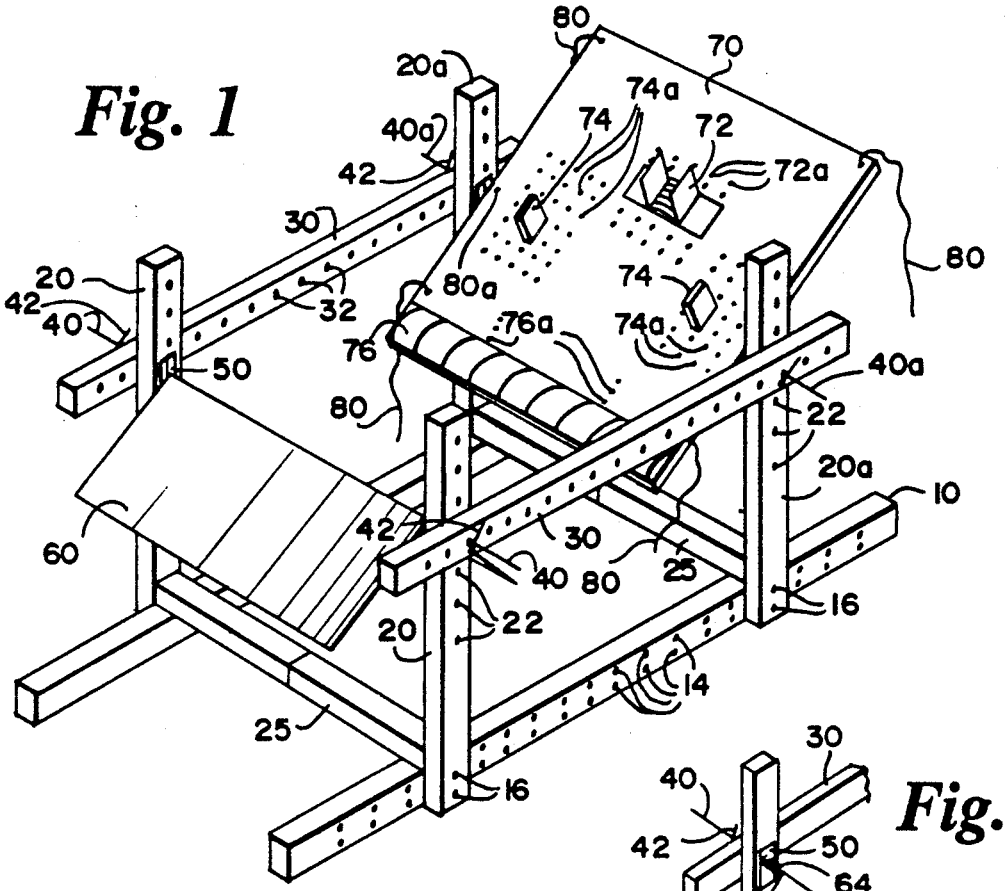
FIG. 1 is a perspective view of the apparatus configured for spine tensioning.

Referring to FIG. 1, the apparatus comprises two parallel elongated horizontal base members 10, each having separation adjustment holes 14 at predetermined intervals. Vertical risers 20 and 20*a* having height adjustment holes 22 are attached to said base members 10, preferably by inserting bolts 16 through selected separation adjustment holes 14, which allows the horizontal spacing between vertical risers 20 and 20*a* to be adjustable. Preferably, horizontal spacer bars 25 also are provided between the base members 10 to maintain their spacing. Preferably also, the length of the horizontal spacer bars 25 is adjustable so that the distance between the base members 10 can be adjusted.

Figure 2:
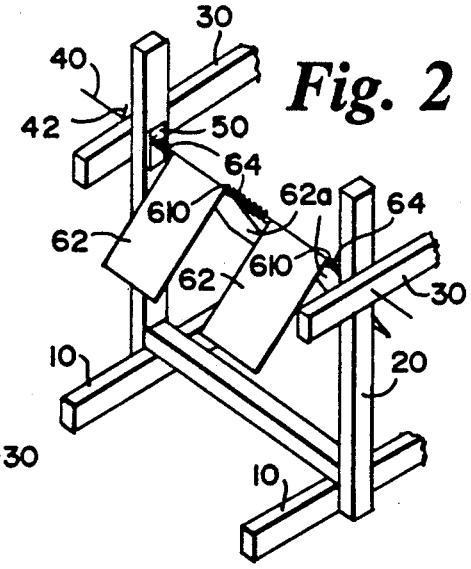
FIG. 2 is a perspective view of an alternate leg support in which each leg has its own support and ability to move side to side with resistance.
Figure 3:
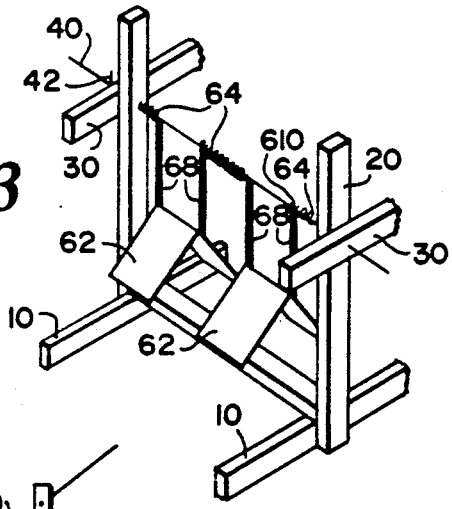
FIG. 3 is a perspective view of an alternate leg support allowing independent forward and backward movement with resistance and side to side movement with resistance.

A dual leg support 60 having an inverted V cross section is positioned at a selected height between vertical risers 20. Alternatively, single leg supports that separately support each leg are shown in FIGS. 2 and 3. Preferably, the leg support(s) are provided with shin cups 620, as shown in FIGS. 6, 7 and 8. The shin cups 620 are retained by being placed over the edge of the leg support(s) and being secured by nut 630, as shown in FIG. 8. The upward movement of the lower portion of leg support 60 or 62 has adjustable tension by way of tension nut 682 shown in FIG. 7, through horizontal rod 40*b* to locking pin 610*a* connecting the lower portion of leg support 60 or 62, to shin cup 620. Preferably, the angle between the two portions of the inverted V 60 and 60*a* can be adjusted to varying support angles so that the leg support 60 can be collapsed into a flat configuration for storage and portability, as shown in FIG. 7. The lead block 650 has stop pin positions along track 640 from which angle brace bar 660 pivots from 670 allowing different angles between 60 and 60*a* or 62 and 62*a*.

A back support 70 having a planar surface, neck adjustment holes 72*a*, armpit adjustment holes 74*a* and lumbar adjustment holes 76*a* is positioned at a selected height between vertical risers 20*a*. Of course, the back support 70 is aligned with the leg support 60 so that the user's back will be supported by the back support 70 and his legs will be supported by the leg support 60.

Figure 4:
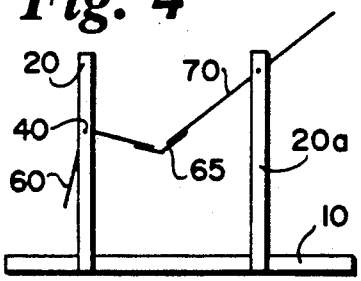
FIG. 4 is a side view of the apparatus with an additional member attached to allow use as a chair.

If it is desired to use the apparatus as a chair, the vertical risers 20 and 20*a* are moved closer together into the position shown in FIG. 4 and a connector 65 may be connected.

Preferably, the leg support and back support are rotatably held in position by horizontal rods 40 and 40*a*. Leg support horizontal rod 40 is preferably inserted through one of the height adjustment holes 22 in one vertical riser 20, through leg support 60 and on through the corresponding height adjustment hole 22 in the other vertical riser 20. Back support horizontal rod 40*a* is preferably inserted through one vertical riser 20*a*, through one of the height adjustment holes 22, through back support 70 and on through the corresponding height adjustment hole 22 in the other vertical riser 20*a*. Preferably, neither of the rods is centered in support.

Figure 5:
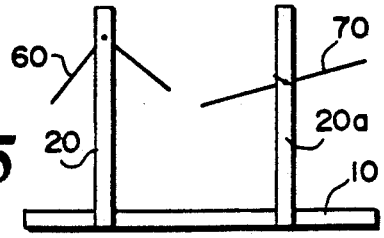
FIG. 5 is a side view of the body support indicating varying configurations of the leg and back supports.
Figure 15:
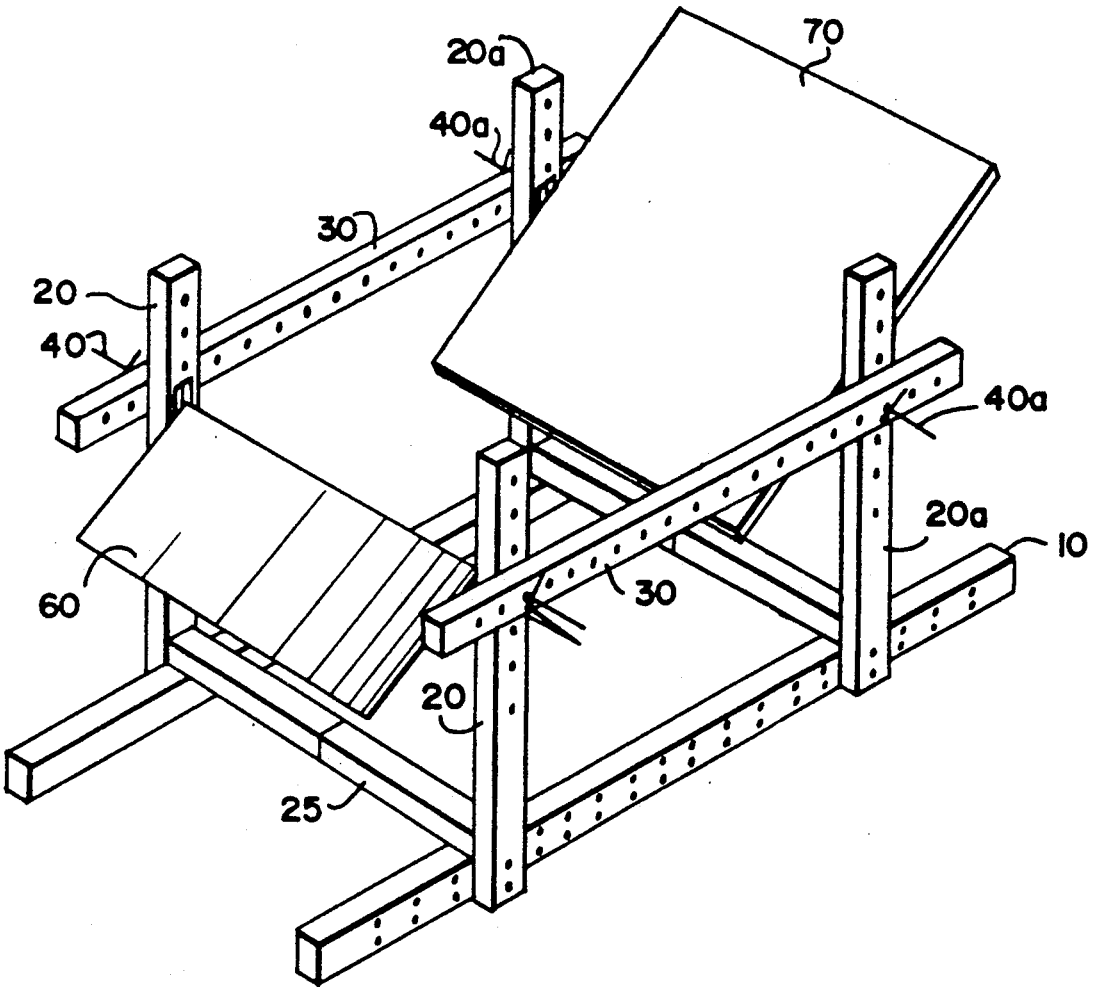
FIG. 15 is a perspective view of the apparatus configured for spine tensioning without neck, back or lumbar support.
Figure 18:
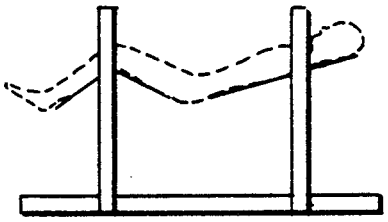
FIG. 18 is a side view of a person in a near horizontal position, subject to very low tension.
Figure 19:
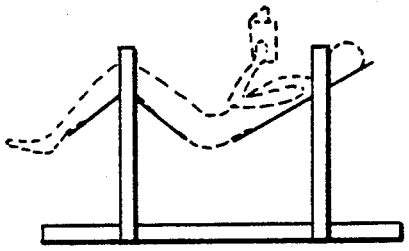
FIG. 19 is a side view of a person in a low tension with freedom to read.
Figure 20:
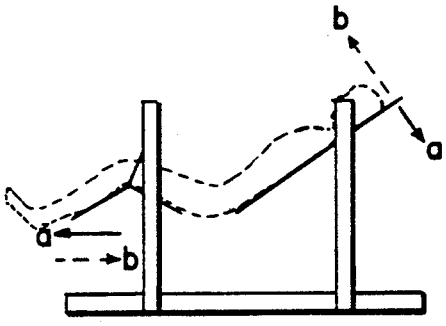
FIG. 20 is a side view indicating corresponding a and b movements of leg and back support when practicing a form of rocking.
Figure 21:
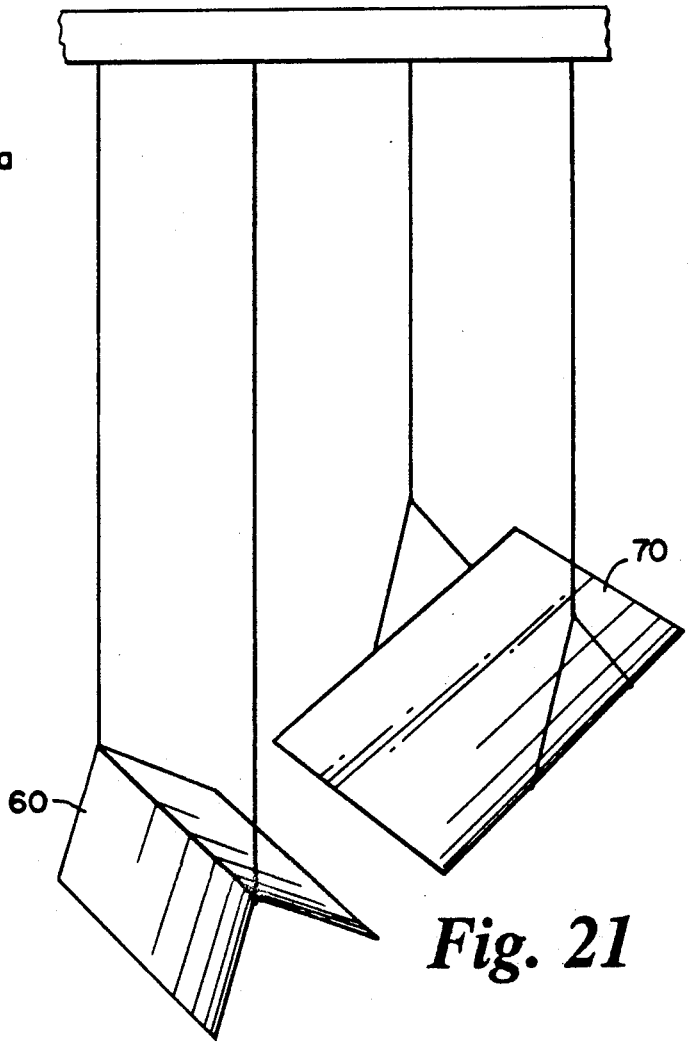
FIG. 21 is a perspective view of an alternative embodiment in which the back support and leg support are suspended by rope from an elevated member.

The lateral support members 30 are then slid onto horizontal rods 40 and 40*a* on both sides and cotter pins 42 are set outside the lateral support members 30 to retain them in place. Referring to FIG. 5, the configuration shown would not require armpit or neck support to maintain the occupant's position, due to the shallow angle of the back support (lumbar support is recommended). Note that some mild tensioning of, at least, the lower spine and legs would occur because of the lack of posterior support. The armpit and neck supports are not preferred until the back support 60 reaches a steep enough angle to overcome the friction created by the occupant's upper body on the back support 60. At this point, it becomes preferred to utilize the armpit support 74, or the neck support 72, or both.

Referring to FIGS. 13 and 14, the neck support 72 can be set for height and width by adjusting the distance between the arcuate halves 72*j* and 72*f* and anchoring the neck support by placing anchor bolts 72*h* through selected neck support holes 72*a*. Similarly, armpit supports 74 are adjusted for location and set by sliding anchor bolts 74*h* through selected armpit support holes 74*a*. Instead of using bolts and holes, however, other methods of fastening, such as the use of hook and loop fastener (Velcro ®), can be used.

When using the apparatus, the user stands between the lateral support members 30 with the leg support 60 in front. With arms on the lateral support members 30, the user's legs are lifted over the leg support 60 one at a time. When both legs are over the leg support 60, the user can lower his or her upper body until the back comes to rest on the back support 70. Minor repositioning may be required to ensure a comfortable position on the lumbar support 76, armpit support 74, and neck support 72. While in this position it is possible to freely rotate the angle of both the back support 70 and the leg support 60.

In order to allow the apparatus to be used for exercise, rod tensioners 50 preferably are included to provide resistance to rotation of the rods 40 and 40*a*. A side view of a typical rod tensioner 50 is presented in FIG. 11. The rod tensioners 50 are mounted on the vertical risers 20 and 20*a* at the selected height adjustment holes 22 for the desired heights for the horizontal rods 40 and 40*a*. When setting the rod tensioner 50 it is important to place the rod tensioner stabilizer 52 into a height adjustment hole 22 on the vertical support 20 or 20*a*. The rod tensioners 50 should be set flush against the vertical risers 20 and 20*a* so the locking pin 58 can be set at all four points of attachment with the leg support 60 and the back support 70. By tightening the rod tensioner nut 54, the resistance to rotation of the rods 40 and 40*a* can be adjusted from no resistance to locked tight. This resistance is translated into leg support 60's or 62's forward and backward movement by way of lock nut 610 in the alternate form of leg support shown in FIGS. 3 and 7. The rotational movement of 60 or 62 is adjusted by the rod tensioner nut 682.

A further modification for the form of leg support shown in FIG. 2 would be to add springs 64 on the sides of leg supports 62 or support hangers 68 while inserting rod 40. Another option would be to utilize support hangers 68 between horizontal rod 40 and the outer edges of single leg supports 62 (FIG. 3) or dual-leg support 60 (not shown).

If rod tensioners 50 are provided, the user has the ability to adjust the rotational resistance of the back support 70 and the dual-leg support 60 or the single-leg supports 62. If the leg support hangers 68 are utilized for dual-leg support, or the single leg support, then the rotational resistance created by the rod tensioners 50 will be transferred to forward to backward resistance of the leg supports 60 or 62 by way of lock-nut 610, as shown in FIG. 7. Alternately, one could attach the shin cups 620 to 60 or 62 and tighten the rod tensioner nut 682 to adjust the rotational resistance of 60 or 62.

A further modification allowing exercise of the upper body is to attach resilient members, preferably lengths of surgical tube, to various portions of the back support 70. Preferably, one pair of tubes will be provided at each of the top and bottom of the back support 70. Alternately, the tubes would attach to a headband providing resistance for neck muscle exercises in the absence of the neck support.

It can be seen that, with these modifications, the user can move his knees in and out, thereby exercising the outer muscles of his legs and lower back. The user also can move his knees forward and backward, exercising stomach and lower back muscles. Rotating the back support 70 against the rotational resistance created by the rod tensioners 50 will enable the user to strengthen stomach and upper body muscles. The user also can exercise arm and upper body muscles by using either the top or bottom pair of resilient tubes 80.

The amount of limited tension on the spine can be adjusted by changing the angle of the back support 70. The greater the angle of the back support 70, the greater the back tension on the spine. Another means to increase the limited tension of the spine would be to increase the distance between the vertical risers 20 and 20*a*, increasing the portion of the body that is unsupported and thereby increasing the limited tension on the spine. The tension can be distributed more thoroughly up the spine by raising the neck support 72, or conversely, the neck support 72 could be lowered and more support could be placed on the armpit supports 74.

The leg supports 60 or 62 and/or the back support 70, can be mounted for rotation in two orthogonal planes using the bi-planar rotational support device shown in FIGS. 16 and 17.

This bi-planar rotational support device consists of a block 400 in which hole 410 is provided for allowing either rod 40 or 40*a* to pass through. From this block 400 hangs swivel block 420 which allows support rod 450 to rotate horizontally with resistance set free or locked tight by tightening nut 430. Horizontal support rod 450 is rectangular at its mid region so it will slide up into swivel block 400 and be held by tension bolt 440. With tension bolt 440, the vertical rotational resistance of support rod 450, in FIGS. 16 and 17, can be adjusted. It will be noted that rod 460 in FIGS. 16 and 17 is intended to support either leg support 60 or back support 70. A support setup similar to FIG. 3 utilizing bi-planar rotational movement with, if desired, resistance would require two bi-planar rotational support devices. Finally, forward and backward movement of 450 will be adjustable from free to locked rotation by way of resistance setting nut 402 and rod tensioners 50.

Alternately, support 68 may be utilized to support back support 70. An additional full length rod 40L would be required with the same tension nut 682.

The apparatus can be collapsed into a relatively flat configuration. The vertical risers 20 and 20*a* would lay atop the base horizontal supports 10 and 20 along with the lateral support members 30 and back supports 70 with the neck support 72 and armpit support 74 detached. The leg support 60 could have its shin cups 620 detached and the angle between the leg support halves 60 and 60*a* could be increased to 180 degrees leaving them flat also by releasing 650.

The invention has been described above only with respect to a particular preferred embodiment and it will be apparent to those skilled in the art that many modifications and alterations can be made without departing from the scope and spirit of the invention. Accordingly, no limitations are to be implied or inferred except as specifically set forth in the appended claims.

What is claimed is:

1. A spine tensioning body support, comprising:

a back support adapted to support a user's back having a substantially planar surface, a top edge, a bottom edge, a left side and a right side;

a leg support having a left side and a right side and an inverted V shaped cross section defining an apex, a portion of said leg support on one side of said apex being adapted to contact and support a user's upper leg and a portion of said leg support on the other side of said apex being adapted to contact and support a user's lower leg; and positioning means for positioning and retaining said back support in a position aligned with and spaced apart from said leg support sufficiently to prevent a user's posterior from being supported by said back support, whereby only a user's back will be supported by said back support and only a user's legs will be supported by said leg support, and whereby said user's spine is placed in tension.

2. A spine tensioning body support, according to claim 1, wherein said positioning means comprises:
an elevated member; and
rope suspended from said member and attached to said back support and said leg support.

3. A spine tensioning body support, according to claim 1, wherein said positioning means comprises:
a horizontal base;
a. back support riser attached to said base, rising above said base and attached to said back support; and
a leg support riser attached to said base, rising above said top surface and attached to said leg support.

4. A spine tensioning body support, according to claim 3, wherein said leg support is rotatably mounted on said leg support riser for rotation in two orthogonal planes.

5. A spine tensioning body support, according to claim 3, further comprising:
a lead block between both legs of said inverted V whereby said legs can be adjustably rotated about said apex to define a selected angle up to 180°.

6. A spine tensioning body support, according to claim 3, further comprising:
shin cups attached to said leg support adapted for retaining a user'shins in said leg support.

7. A spine tensioning body support, according to claim 3, wherein said back support is rotatably mounted on said back support riser for rotation in two orthogonal planes 8. A spine tensioning body support, according to claim 3, wherein:
said back support riser comprises:
a right back support riser attached to said right edge of said back support between said top edge and said bottom edge;
a left back support riser attached to said left edge of said back support between said top edge and said bottom edge; and
said leg support riser comprises:
a right leg support riser attached to said right edge of said right leg support; and
a left leg support riser attached to said left edge of said left leg support.

9. A spine tensioning body support, according to claim 8, wherein:
said right back support riser and said left back support riser are attached to said back support approximately midway between said top edge and said bottom edge; and
said right leg support riser and said left leg support riser are attached to said leg support at said apex.

10. A spine tensioning body support, according to claim 9, wherein:
said back support risers are rotatably attached to said back support; and
said leg support risers are rotatably attached to said leg support.

11. A spine tensioning body support, according to claim 10, wherein:
said leg support comprises:
a right leg support adapted for supporting a user's left leg; and
a left leg support adapted for supporting a user's right leg.

12. A spine tensioning body support, according to claim 10, further comprising:
means for adjusting rotational resistance of said back support about said back support risers; and
means for adjusting rotational resistance of said leg support about said leg support risers.

13. A spine tensioning body support, according to claim 1, further comprising:
a neck support comprising two halves spaced apart from each other and attached to said back support between said right and left sides of said back support and spaced apart from said top edge.

14. A spine tensioning body support, according to claim 13, wherein said neck support comprises a resilient left arcuate member and a resilient right arcuate member spaced apart from each other, wherein each of said arcuate members has a convex side and said convex sides face each other.

15. A spine tensioning body support, according to claim 14, wherein said arcuate members comprise portions of foam sheet.

16. A spine tensioning body support, according to claim 8, further comprising:
a left armpit support attached to said back support adjacent to said left edge and closer to said bottom edge than said neck support; and
a right armpit support attached to said back support adjacent to said right edge and closer to said bottom edge than said neck support.

17. A spine tensioning body support, according to claim 16, further comprising:
a lumbar support pad attached to said bottom edge of said back support.

18. A spine tensioning body support, comprising:
two parallel elongated horizontal base members;
two vertical leg support risers attached near adjacent ends of each of said base members;
two vertical back support risers attached near adjacent ends of each of said base members opposite said leg support risers;
two horizontal spacer bars attached to said base members maintaining said base members in parallel relationship;
a leg support with an inverted V shaped cross section defining an apex rotatably attached between said leg support risers;
a substantially planar back support rotatably attached between said back support risers; and
a lateral support member attached to and extending between each of said leg support risers and said back support risers.

19. A spine tensioning body support, according to claim 18, wherein said back support is mounted between said back support risers on a back support rod.

20. A spine tensioning body support, according to claim 19, wherein said leg support is mounted between said leg support risers on a leg support rod.

21. A spine tensioning body support, according to claim 20, further comprising:
leg support hangers mounted between said leg support rod and said leg support.

* * * * *